US011162481B2

(12) United States Patent
Breuer et al.

(10) Patent No.: US 11,162,481 B2
(45) Date of Patent: Nov. 2, 2021

(54) AXIAL PISTON MACHINE WITH PRESSURE RELIEF IN THE THROUGH DRIVE SPACE

(71) Applicant: Robert Bosch GmbH, Stuttgart (DE)

(72) Inventors: David Breuer, Tuebingen (DE); Timo Nafz, Horb (DE)

(73) Assignee: Robert Bosch GmbH, Stuttgart (DE)

( * ) Notice: Subject to any disclaimer, the term of this patent is extended or adjusted under 35 U.S.C. 154(b) by 273 days.

(21) Appl. No.: 16/381,635

(22) Filed: Apr. 11, 2019

(65) Prior Publication Data

US 2019/0323489 A1 Oct. 24, 2019

(30) Foreign Application Priority Data

Apr. 18, 2018 (DE) ..... 10 2018 205 884.9

(51) Int. Cl.
*F04B 1/30* (2020.01)
*F03C 1/40* (2006.01)
(Continued)

(52) U.S. Cl.
CPC ..... *F04B 1/303* (2013.01); *F03C 1/0636* (2013.01); *F03C 1/0692* (2013.01); *F04B 1/20* (2013.01); *F04B 1/2042* (2013.01); *F04B 49/08* (2013.01)

(58) Field of Classification Search
CPC .. F04B 11/0091; F04B 1/2021; F04B 1/2064; F04B 19/22; F04B 1/124; F04B 1/145;
(Continued)

(56) References Cited

U.S. PATENT DOCUMENTS 3,362,342 A 1/1968 Flint et al.
3,858,483 A * 1/1975 Hein ..... F01B 3/0055 91/6.5
(Continued)

FOREIGN PATENT DOCUMENTS

DE 10 2013 008 676 A1 12/2014
EP 0 953 767 B1 11/1999
JP H08-284805 A 10/1996

OTHER PUBLICATIONS

German Search Report corresponding to German File No. 10 2018 205 884.9; dated Apr. 18, 2018; 9 Pages.
(Continued)

*Primary Examiner* — Dominick L Plakkoottam
(74) *Attorney, Agent, or Firm* — Maginot, Moore & Beck LLP

(57) ABSTRACT

A swashplate-type axial piston machine includes a housing, a first pivot bearing received in the housing, a drive shaft rotatably mounted in respect of an axis of rotation, a cylinder drum, a control plate, a third control aperture in the plate, and a first channel arranged in the housing. The first pivot bearing delimits a first and second housing space from one another. The drum and the plate are arranged in the first housing space. The plate has at least a first and at least a second control aperture. The first aperture is in fluidic exchange connection with a first fluid connection on the housing. The second aperture is in fluidic exchange connection with a second fluid connection on the housing. The third aperture is arranged in the peripheral direction between a first and a second aperture. The first channel fluidically connects the third aperture to the second housing space.

11 Claims, 4 Drawing Sheets

(51) Int. Cl.

| | |
|---|---|
| ***F03C 1/06*** | (2006.01) |
| ***F04B 1/20*** | (2020.01) |
| ***F04B 1/303*** | (2020.01) |
| ***F04B 1/2042*** | (2020.01) |
| ***F04B 49/08*** | (2006.01) |

(58) Field of Classification Search
CPC ..... F04B 1/20; F04B 1/2035; F04B 1/2071; F04B 1/2078; F04B 49/08; F04B 53/16
See application file for complete search history.

(56) References Cited

U.S. PATENT DOCUMENTS

| | | | | | |
|---|---|---|---|---|---|
| 4,489,642 | A * | 12/1984 | Westveer | F04B 1/2042 | 417/53 |
| 4,934,253 | A * | 6/1990 | Berthold | F04B 1/2042 | 91/506 |
| 5,172,623 | A | 12/1992 | Poisson | | |
| 6,361,285 | B1 * | 3/2002 | Lehner | F04B 1/2042 | 417/269 |
| 2008/0295680 | A1 * | 12/2008 | Kunze | F04B 1/2042 | 91/392 |
| 2009/0013864 | A1 * | 1/2009 | Mohn | B22D 11/009 | 92/71 |
| 2009/0199705 | A1 * | 8/2009 | Zug | F04B 1/205 | 92/13 |
| 2016/0108901 | A1 * | 4/2016 | Pass | F04B 1/2035 | 417/269 |
| 2017/0045028 | A1 * | 2/2017 | Iida | F03C 1/0626 | |
| 2019/0234388 | A1 * | 8/2019 | Andersen | F04B 1/2021 | |

OTHER PUBLICATIONS

Bosch Rexroth AG; Axial piston variable pump, RE 92650; 24 Pages.

* cited by examiner

AXIAL PISTON MACHINE WITH PRESSURE RELIEF IN THE THROUGH DRIVE SPACE

This application claims priority under 35 U.S.C. § 119 to patent application no. DE 10 2018 205 884.9, filed on Apr. 18, 2018 in Germany, the disclosure of which is incorporated herein by reference in its entirety.

BACKGROUND

The disclosure relates to a swashplate-type axial piston machine.

A swashplate-type axial piston machine is known from the data sheet which was available on May 4, 2018 from the following web address http://www.boschrexroth.com/various/utilities/mediadirectory/download/index.jsp?object_nr=RE92650. The axial piston machine may be fitted with a so-called through drive, so that a plurality of axial piston machines adjoining one another in series can be driven in parallel by a single motor.

A further axial piston machine is known from EP 953 767 B1, in which the control plate is provided with a third control aperture arranged between the first and the second control aperture, wherein the aforementioned control apertures are connected to the fluid connections.

SUMMARY

One advantage of the disclosure is that the high pressure present in a cylinder bore which moves from the high-pressure side to the low-pressure side is reduced in a controlled manner, so that the axial piston machine runs with low noise. Cavitation is largely avoided in this case. Consequently, there is no risk of cavitation-induced wear. This kind of wear occurs particularly on the control plate which is typically made of brass.

According to the disclosure, it is proposed that a third control aperture is arranged in the control plate between a first and a second control aperture, wherein a first channel which fluidically connects the third control aperture to the second housing space is arranged in the housing. The second housing space is also referred to as the through drive space, as the rotary drive connection of two adjacent axial piston machines typically takes place there. It should be noted in this case that the disclosure can also be used when the through drive is not used. It is sufficient for a second housing space or a through drive space to be present on the axial piston machine.

The axial piston machine is preferably used with a pressure fluid which is extremely preferably a fluid, for example a hydraulic oil. The drive shaft may be rotatably mounted with a second pivot bearing in relation to the axis of rotation, wherein the second pivot bearing is preferably arranged on the side of the cylinder drum facing away from the first pivot bearing. The cylinder drum may be integrally configured with the drive shaft, wherein the aforementioned components are preferably configured separately from one another. In the cylinder drum a plurality of pistons may be received in a linearly movable manner in an assigned cylinder bore in each case. The axial piston machine may exhibit a planar drive surface which can be arranged at an angle differing by 90° from the rotational axis, wherein the pistons are movement-coupled to the drive surface, preferably via separate, tiltable slide shoes in each case. The control plate may be made of brass. It is preferably configured as a planar plate with a constant thickness. The control plate is preferably secured to the housing to prevent rotation about the axis of rotation and to prevent displacement transversely to the axis of rotation. The cylinder bores can preferably be brought into fluidic exchange connection through rotation of the cylinder drum selectively with the at least one first control aperture and/or the at least one second control aperture and/or the third control aperture. The first and/or second and/or third control aperture passes through the control plate, preferably in the direction of the axis of rotation. The drive shaft preferably projects into the second housing space, wherein it can be brought into rotary drive connection there with the drive shaft of a further hydraulic machine. The first housing space is preferably provided with a leakage oil connection, wherein the second housing space may also be provided with a leakage oil connection.

Advantageous developments and improvements of the disclosure are disclosed herein.

It may be provided that the cross-sectional area of the first channel increases constantly from the third control aperture to the second housing space. In this way, the flow speed in the first channel to the second housing space decreases constantly, so that the cavitation tendency drops further. It is understood that a first channel with a constant cross-sectional area can be produced more easily, so that this embodiment is preferred, provided no cavitation occurs which leads to wear.

It may be provided that the third control aperture has a constant circular cross-sectional shape. The third control aperture is therefore easy to produce. The third control aperture preferably runs parallel to the axis of rotation.

It may be provided that the third control aperture and the first channel are directly opposite, wherein a cross-sectional area of the first channel in the corresponding transitional region is larger than a cross-sectional area of the third control aperture. It is thereby ensured that the third control aperture opens out completely within the first channel irrespective of tolerance.

It may be provided that the first channel has a straight or curved, kink-free profile. The straight shape is preferable if the first channel is produced by machining, for example by means of drilling. The curved shape may be used if the first channel is produced by casting. With the curved shape, a tangential or kink-free transition between the third control aperture and the first channel can be achieved. In this way, the cavitation tendency in this region drops.

It may be provided that a second channel is arranged in the housing, via which the first housing space is fluidically connected to the second housing space. In this way, a separate leakage oil connection on the second housing space can be dispensed with. The second channel preferably has a straight profile. It preferably has a constant cross-sectional shape which is extremely preferably circular in configuration.

It may be provided that a smallest cross-sectional area of the second channel is larger than a largest cross-sectional area of the first channel. It is thereby ensured that the pressure reduction takes place primarily in the first channel, wherein virtually no pressure reduction takes place in the second channel. This means that virtually the same pressure prevails in the first and second housing space.

It may be provided that an outlet opening of the second channel is arranged in the region of an outer peripheral surface of the control plate. A particularly short second channel results in this case. The aforementioned outlet opening may be partially covered by the control plate, in order to save on installation space. It is also possible, however, for the outlet opening to be completely arranged outside the outer peripheral surface of the control plate.

It may be provided that the second housing space comprises a protrusion into which the second channel opens out. The second channel may therefore be straight in configuration and is therefore easy to produce. The aforementioned protrusion is preferably already provided in the unmachined casting of the housing, so that it can likewise be produced cost-effectively.

It may be provided that the first and the second channel are configured such that when the axial piston machine is operating, a higher pressure prevails in the second housing space than in the first housing space. In this way, the cavitation tendency can be further reduced, insofar as this is necessary.

It is understood that the features referred to above and the features yet to be explained below can not only be used in the combination indicated in each case, but also in other combinations or in isolation, without departing from the framework of the disclosure.

BRIEF DESCRIPTION OF THE DRAWINGS

The disclosure is explained in greater detail below with the help of the attached drawings. In the drawings.

DETAILED DESCRIPTION

Figure 1:
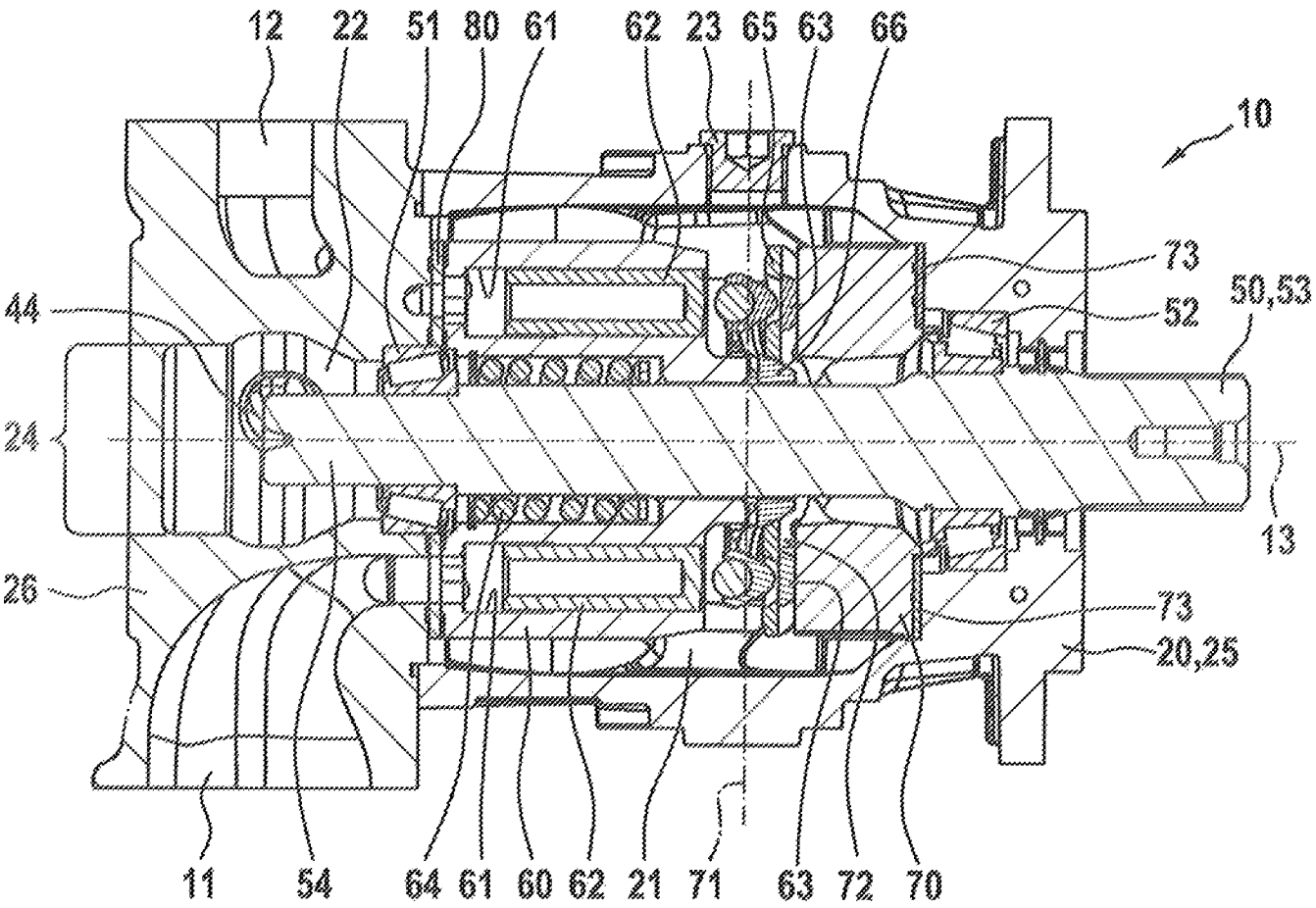
FIG. 1 shows a longitudinal section of an axial piston machine according to the disclosure.

FIG. 1 shows a longitudinal section through an axial piston machine 10 according to the disclosure, wherein the sectional plane runs through the axis of rotation 13. The axial piston machine 10 has a housing 20 which is made up of a first and a second housing part 25, 26. The first housing part 25 has a pot-like design, wherein it defines the first housing space 21. The second housing part 26 has a connection-plate-type design, wherein it has a first and a second fluid connection 11; 12. The second housing part 26 defines a second housing space 22, wherein it delimits the first housing space 21 along with the first housing part 25. A first pivot bearing 51 which is received in the second housing part 26 is arranged between the first and second housing space 21; 22. A second pivot bearing 52 is moreover received in the first housing part 25. A drive shaft 50 is rotatably mounted in respect of an axis of rotation 13 in the first and in the second pivot bearing 51; 52. The drive shaft 50 projects with a drive pin 53 from the housing 20, wherein it projects with a through-drive pin 54 into the second housing space 22. The drive pin and through-drive pin 53; 54 may be provided with a multi-spline profile, for example. The first and the second pivot bearings 51; 52 may be configured as a tapered roller bearing, for example. The through-drive pin 54 may be used to drive a further hydraulic machine, wherein the wall portion of the housing 20 labelled no. 24 is drilled for this purpose.

Between the first and the second pivot bearing 51; 52 the drive shaft 50 is surrounded by a cylinder drum 60 which is in rotary drive connection with the drive shaft 50 in the present case via a multi-spline profile. A control plate 80 is fitted between the cylinder drum 60 and the second housing part 26. In the pressureless state, the cylinder drum 60 is pressed by the spring 64 against the control plate 80 and the second housing part 26, so that they bear against one another in a gapless manner. If the axial piston machine 10 is under pressure, a hydraulic contact force moreover takes effect.

The cylinder drum 60 is provided with multiple cylinder bores 61 which are uniformly distributed about the axis of rotation 13. An associated piston 62 is received in each cylinder bore 61 in a linearly movable manner. The corresponding movement direction may be parallel or slightly inclined relative to the axis of rotation 13. The pistons 62 project out of the cylinder drum 60 with one end, wherein they are each provided with a tiltable slide shoe 63 there via a ball joint. The slide shoe 63 slides on a planar drive surface 72 which is arranged on a separate pivot cradle 70 in the present case, wherein it may also be fixedly arranged on the housing 20, in particular on the first housing part 25. The pivot cradle 70 is tiltably mounted in two pivot bearings 73 in respect of a pivot axis 71. The pivot axis 71 is arranged perpendicularly to the axis of rotation 13, wherein it intersects said axis of rotation or is arranged at a small distance therefrom. The pivot bearings 73 in the present case are configured as slide bearings, wherein an anti-friction bearing-mounted pivot cradle can also be used. By pivoting the pivot cradle 70, the drive surface 72 can be moved into a position in which it adopts an angle that differs by 90° C. in respect of the axis of rotation 13.

The pistons 62 with the slide shoes 63 bear against the working surface 72 when the axial piston machine 10 is under pressure. Accordingly, they perform a lifting movement when the cylinder drum 60 turns. So that the lifting movement takes place even when the axial piston machine 10 is pressureless, the retraction plate 65 is provided which rests against a pressure ring 66 via a ball surface, wherein the pressure ring 66 is in turn supported by the drive shaft 50.

Reference should also be made to the leakage oil connection 23 on the first housing part 25 which is closed using a locking screw in the present case. The leakage oil connection 23 is preferably attached to a tank during operation. It should further be recognized how the first fluid connection 11, in particular, is fluidically connected to the control plate 80, wherein reference is made to the embodiments in FIG. 4 for further details.

Figure 2:
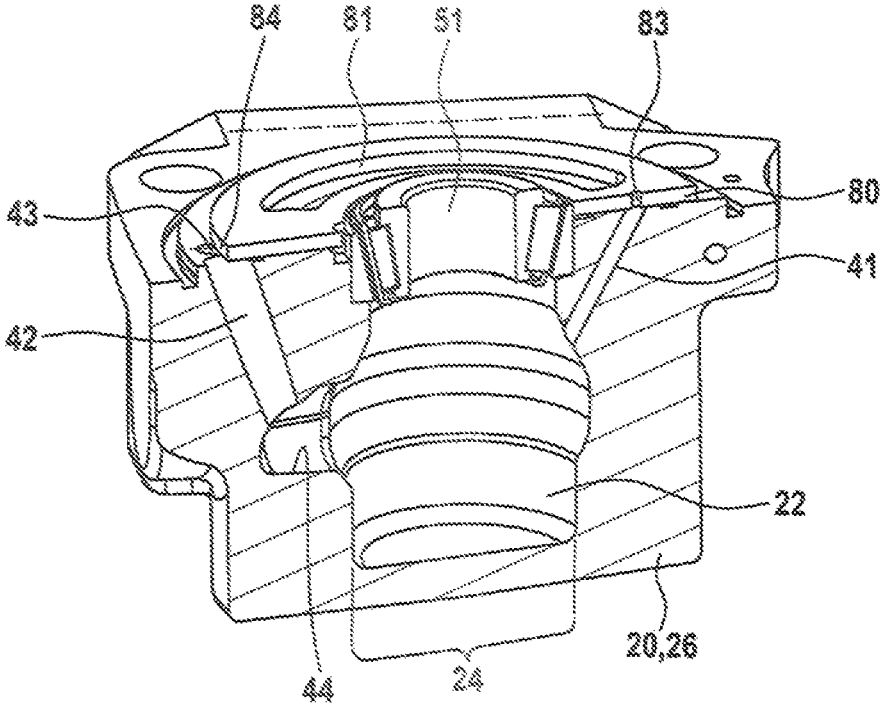
FIG. 2 shows a sectional view of the second housing part with control plate of the axial piston machine according to FIG. 1.

FIG. 2 shows a sectional view of the second housing part 26 with the control plate 80 of the axial piston machine according to FIG. 1. The corresponding sectional plane runs through the first and the second channel 41; 42 in the second housing part 26. The control plate 80 is configured as a planar plate with a constant thickness, which is preferably made of brass. Radially inwardly it bears against the outer ring of the first pivot bearing 51, so that it is secured to prevent displacement transversely to the axis of rotation. The control plate 80 has a first 81, a second (no. 82 in FIG. 4) and a third control aperture 83. The third control aperture 83 is configured as a circular-cylindrical bore which passes through the control plate 80 in the direction of the axis of rotation. If a cylinder bore is above the third control aperture 83, pressure fluid which is contained under pressure can be relieved via the third control aperture 83, further via the first channel 41 to the second housing space 22. The aforementioned flow path in this case runs largely along a straight line, so that virtually no cavitation phenomena occur. The length and diameter of the first channel 41 in this case are designed in such a manner that the pressure along the first channel drops constantly in a friction-induced manner. The diameter of the third control aperture 83 is smaller than the constant diameter of the first channel 41. In this way it is ensured in each tolerance position that the third control aperture 83 is not covered by the second housing part 26. Instead, it opens out with its entire outlet opening into the first channel 41. The first channel 41 has a straight design, wherein it runs in an inclined manner to the axis of rotation in such a manner that it opens into the second housing space 22.

The pressure in the tank or an only slightly higher pressure compared with the pressure in the tank prevails in the second housing space 26. In order to achieve this, the second channel 41 is provided in the present case. This runs with a constant circular cross-sectional shape along a straight line. In this case, it is tilted in respect of the axis of rotation in such a manner that it opens out into a protrusion 44 of the second housing space 22. The diameter of the second channel 42 is substantially larger than that of the first channel 41. Accordingly, there is substantially no pressure drop along the second channel 42. In order to minimize the installation space, the outlet opening 43 of the second channel 42 to the first housing space 21 is arranged in such a manner that it is partially covered by the control plate 80. The remaining free opening outlet 43 is so large that there is no excessively great pressure drop. The outlet opening 43 is arranged in the region of an outer peripheral surface 84 of the control plate 80.

Figure 3:
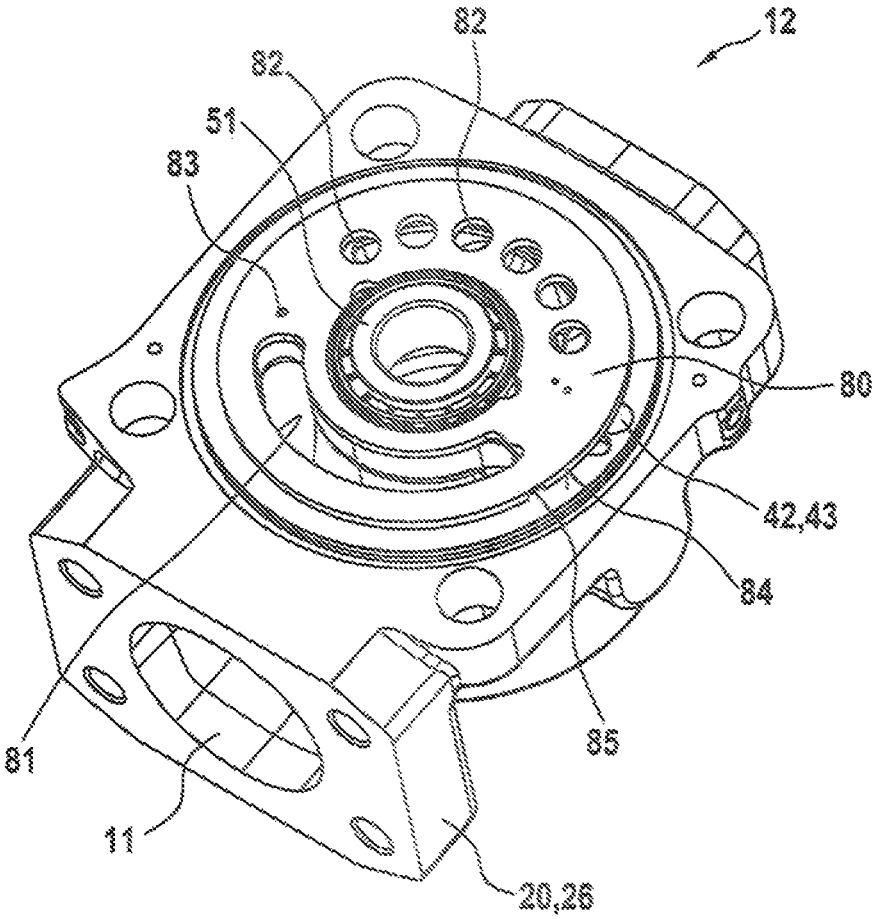
FIG. 3 shows a perspective view of the entire arrangement according to FIG. 2 from the control plate.

FIG. 3 shows a perspective view of the overall arrangement according to FIG. 2 from the control plate 80. The first, second and third control apertures 81; 82; 83 which are arranged along a circle, the center point whereof is defined by the axis of rotation, can be identified in particular. The single first control aperture 81 in this case is kidney-shaped, wherein it extends with a constant width along the aforementioned circle. In this way, a particularly large open cross-sectional area is produced. A total of six second control apertures 82 are arranged along the aforementioned circle in this case. These are circular in design, wherein the circular cross section thereof is slightly smaller than the width of the first control aperture 81. The high pressure of the axial piston machine is applied in the region of the second control apertures 82, wherein the many separate second control apertures 82 exhibit a greater pressure resistance than a single kidney-shaped control aperture.

The third control aperture 83 which has already been explained is arranged in the peripheral direction between the first control aperture 81 and a second control aperture 82, the diameter whereof is substantially smaller than the width of the first control aperture 81 or the diameter of the second control apertures 82. The direction of rotation of the cylinder drum is preferably selected in such a manner that the cylinder bores come into fluidic exchange connection with the third control aperture 83 when they move from the second control apertures 82 to the first control aperture 81. Accordingly, the pressure fluid constrained under high pressure in the respective cylinder bore is relieved via the third control aperture 83 to the second housing space 22.

Furthermore, the alignment recess 85 on the outer peripheral surface 84 of the control plate 80 is still to be referred to. A cylinder pen which is fitted in an associated bore (no. 86 in FIG. 4) engages with said recess. In this way, the control plate 80 is secured relative to the second housing part 26 to prevent rotation.

Figure 4:
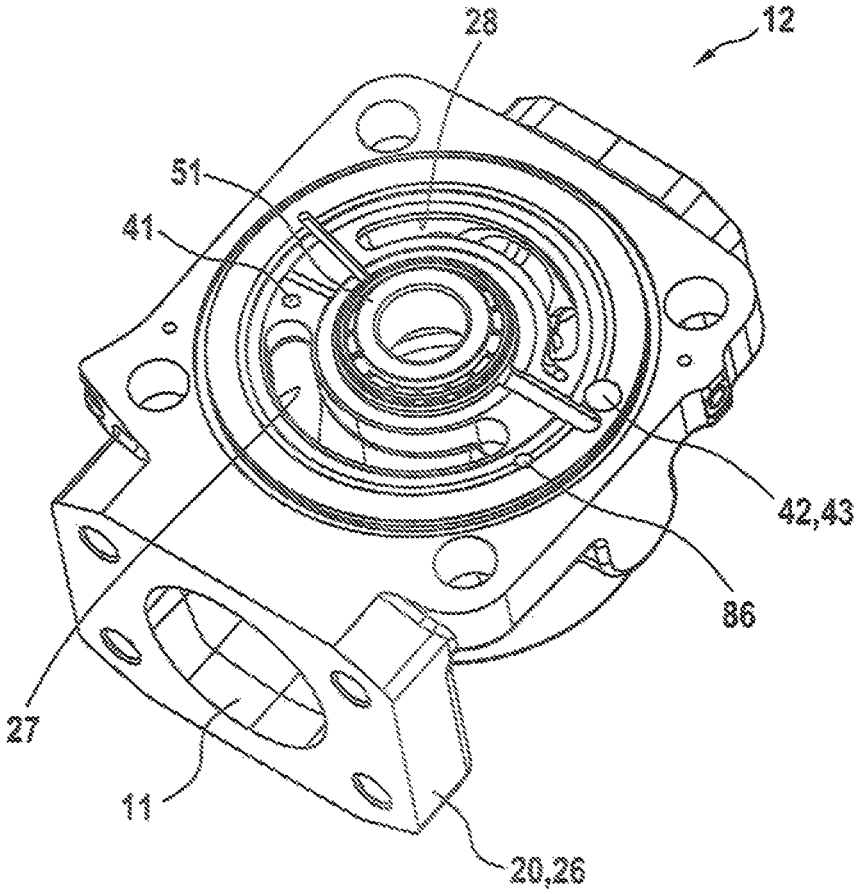
FIG. 4 shows the view according to FIG. 3, but without the control plate.

FIG. 4 shows the view according to FIG. 3 but without the control plate. A first outlet opening 27 which is fluidically connected to the first fluid connection 11 is arranged in the second housing part 26. The form of the first outlet opening 27 is substantially in alignment with the first control aperture on the control plate. A common second outlet opening 28 in the second housing parts 26 is assigned to all second control apertures, which outlet opening is fluidically connected to the second fluid connection 12. The second outlet opening 28 is kidney-shaped, wherein it runs with a constant width along a circle, the center point whereof is defined by the axis of rotation. The aforementioned width is substantially identical to the diameter of the second control apertures.

Furthermore, the outlet opening of the first channel 41 which is arranged in the peripheral direction between the first and the second outlet opening 27; 28 can be seen in FIG. 4.

LIST OF REFERENCE NUMERALS

10 Axial piston machine
11 First fluid connection
12 Second fluid connection
13 Axis of rotation
20 Housing
21 First housing space
22 Second housing space
23 Leakage oil connection
24 Wall portion for through drive
25 First housing part (pot-like)
26 Second housing part (connection plate)
27 First outlet opening
28 Second outlet opening
41 First channel
42 Second channel
43 Outlet opening of the second channel
44 Protrusion
50 Drive shaft
51 First pivot bearing
52 Second pivot bearing
53 Drive pin
54 Through-drive pin
60 Cylinder drum
61 Cylinder bore
62 Piston
63 Slide shoe
64 Spring
65 Retraction plate
66 Pressure ring
70 Pivot cradle
71 Pivot axis
72 Drive surface
73 Pivot bearing
80 Control plate
81 First control aperture
82 Second control aperture
83 Third control aperture
84 Outer peripheral surface
85 Alignment recess
86 Bore for alignment pin

What is claimed is:

1. A swashplate axial piston machine, comprising:

a housing;

a first pivot bearing arranged in the housing, the first pivot bearing and the housing defining a first housing space and a second housing space that are on opposite sides of the first pivot bearing from each other;

a drive shaft rotatably mounted in the first pivot bearing in respect of an axis of rotation;

a cylinder drum arranged in the first housing space, the cylinder drum surrounding the drive shaft and in rotary drive connection with the drive shaft;

a control plate arranged in the first housing space and arranged in a direction of the axis of rotation between the cylinder drum and the housing, the control plate having at least one first control aperture and at least one second control aperture, the at least one first control aperture in fluidic exchange connection with a first fluid connection on the housing, and the at least one second control aperture in fluidic exchange connection with a second fluid connection on the housing;

a third control aperture in the control plate arranged in a peripheral direction between the at least one first control aperture and the at least one second control aperture;

a first channel defined in the housing and fluidically connecting the third control aperture to the second housing space.

2. The axial piston machine according to claim 1, wherein a cross-sectional area of the first channel increases constantly from the third control aperture to the second housing space.

3. The axial piston machine according to claim 1, wherein the third control aperture includes a constant circular cross-sectional shape.

4. The axial piston machine according to claim 1, wherein:

the third control aperture and the first channel are directly adjacent; and a transitional region cross-sectional area of the first channel in a corresponding transitional region that is directly adjacent to the third control aperture is larger than a third control aperture cross-sectional area of the third control aperture.

5. The axial piston machine according to claim 1, wherein the first channel includes a straight or curved, kink-free profile.

6. The axial piston machine according to claim 1, further comprising:

a second channel defined by the housing, the second channel fluidically connecting the first housing space to the second housing space.

7. The axial piston machine according to claim 6, wherein a smallest cross-sectional area of the second channel is larger than a largest cross-sectional area of the first channel.

8. The axial piston machine according to claim 6, wherein the second channel includes an outlet opening arranged adjacent to an outer circumferential surface of the control plate.

9. The axial piston machine according to claim 6, wherein:

the housing further defines a protruding portion of the second housing space; and the second channel opens out into the protrusion.

10. The axial piston machine according to claim 6, wherein the first channel and the second channel are configured such that, when the axial piston machine is operating, a higher pressure prevails in the second housing space than in the first housing space.

11. The axial piston machine according to claim 1, wherein a portion of the drive shaft is arranged in the second housing space.

* * * * *